United States Patent [19]

Dulat et al.

[11] Patent Number: 4,917,330

[45] Date of Patent: Apr. 17, 1990

[54] TARGET SEEKING PROJECTILE

[76] Inventors: Bernd Dulat, Primelweg 5, 7770 Überlingen; Hellmuth Moebes, Im Betzen 12, 7771 Frickingen, both of Fed. Rep. of Germany

[21] Appl. No.: 319,323

[22] Filed: Mar. 3, 1989

[30] Foreign Application Priority Data

Mar. 9, 1988 [DE] Fed. Rep. of Germany ..... 3807725

[51] Int. Cl.[4] ..... F41G 7/26

[52] U.S. Cl. ..... 244/3.16

[58] Field of Search ..... 244/3.16, 3.21

[56] References Cited

U.S. PATENT DOCUMENTS

| | | | |
|---|---|---|---|
| 2,816,721 | 12/1957 | Taylor | 244/3.21 |
| 2,990,699 | 7/1961 | Dennis | 62/511 |
| 3,920,200 | 11/1975 | Evans et al. | 244/3.16 |
| 4,004,754 | 1/1977 | Cox et al. | 244/3.16 |
| 4,009,393 | 2/1977 | Ashley, Jr. et al. | 244/3.16 |
| 4,009,848 | 3/1977 | Albert et al. | 244/3.16 |
| 4,034,807 | 7/1977 | Prince et al. | 166/170 |
| 4,039,246 | 8/1977 | Voigt | 244/3.16 |
| 4,155,521 | 5/1979 | Evans et al. | 244/3.16 |
| 4,329,579 | 5/1982 | Jansen et al. | 250/203 R |
| 4,339,097 | 7/1982 | Kordulla et al. | 244/3.16 |
| 4,413,177 | 11/1983 | Godwin, Jr. et al. | 250/203 R |
| 4,500,051 | 2/1985 | Cottle, Jr. et al. | 244/3.16 |

FOREIGN PATENT DOCUMENTS

| | | |
|---|---|---|
| 0192125B1 | 2/1986 | European Pat. Off. . |
| 3438544A1 | 4/1986 | Fed. Rep. of Germany . |
| 3644456C1 | 1/1988 | Fed. Rep. of Germany . |
| 2199399A | 12/1987 | United Kingdom . |

*Primary Examiner*—Charles T. Jordan

*Attorney, Agent, or Firm*—Lee, Mann, Smith, McWilliams & Sweeney

[57] ABSTRACT

A projectile for launching by a cannon or by a launcher is obtained by an expedient combination of features. An optical seeker has a gyro mounted on an air bearing and an optical detector. A Cassegrain system in arranged on the gyro as imaging optical system and scans a field of view with a gyrating scanning motion. At its tip, the projectile is closed by an optically transparent wedge, which is limited by planar surfaces. The optically transparent wedge carries a central spike. The projectile has tail stabilizing fins and steering by wings arranged near the center of gravity of the projectile. The wings are controlled by signals from the detector through signal processing means and an actuator system. The projectile is shaped make a continuous roll movement due to aerodynamic forces.

6 Claims, 3 Drawing Sheets

TARGET SEEKING PROJECTILE

TECHNICAL FIELD

The invention relates to a projectile with steering means for steering the projectile onto a target during the end phase of its trajectory. The projectile may be cannon launched or may be launched by a launcher.

BACKGROUND ART

DE-C-3,644,456 shows a projectile having an optically transparent window and a central spike.

US-A-4,500,051 shows a cannon launched projectile with a seeker comprising a gyro supported in an air bearing. The projectile has tail stabilizing fins and wings in its mid-portion, said wings being controlled by detector signals.

DE-A-3,438,544 shows an optical seeker comprising a Cassegrain system.

US-A-4,155,521 shows a cannon launched projectile with a gimbal suspended seeker and a gyro with an air bearing.

US-A-4,329,579 shows a target seeking device having a gimbal suspended rotor rotating about its axis with two degrees of freedom about a central point of rotation. The device includes a detector fixed with respect to the housing of the device, an optical system by which the field of view of the device is imaged in the plane of the detector, means for producing relative motion between the field of view image and the detector, a signal evaluating circuit, means for producing precession motion of the gyro rotor relative to the housing, and position sensors which respond to the angular position of the gyro rotor relative to the housing. A torquer is provided and receives scanning signals. The signals of the position sensors are applied to the torquer through a feedback loop. An evaluation circuit is provided for producing follow up signals from the detector signals and the position sensor signals.

The imaging optical system is a Cassegrain system. The tip of the missile is closed by a substantially spherical dome.

The geometrical axis of the gyro rotor itself executes a scanning motion. This is achieved by the scanning signals applied to the torquer. The position sensors provide the reaction of the gyro rotor to these scanning signals and are applied to a feedback loop. Thereby a well-defined scanning motion is achieved.

US-A-4,339,097 shows a target seeking head mounted in a dome of a missile. This target seeking head comprises a gyro rotor including a mid-portion forming a calotte-shaped peripheral surface. The convex calotte-shaped peripheral surface is surrounded substantially concentrically by a concave calotte-shaped bearing surface stationary with respect to the missile. A small gap is formed between the two surfaces. Pressurized gas is introduced into the gap to form a gas bearing centering the gyro. A target seeking scanning device comprises an annular parabolic mirror formed at the mid-portion of the gyro and a plane mirror imaging a field of view located at infinity in the plane of a detector mounted stationary with respect to the missile.

US-A-2,990,699 and GB-A-2,199,399 disclose cryostatic devices for cooling an infrared detector.

EP-B-0,192,125, US-A-4,039,246, US-A-4,009,393, EP-A-0,079,684 US-A-4,034,807 and US-A-4,413,177 disclose scanning devices with optically refracting, rotating wedge elements.

DISCLOSURE OF INVENTION

It is the object of the invention to steer a projectile, which is launched by a cannon such as that of a tank, onto a movable target during the end phase of its trajectory.

Such steering presents a number of quite considerable problems. When such projectile is launched or fired, it is, during a short time interval, subjected to extremely high accelerations. Steering means have to endure these high accelerations. During the steering phase, high transverse acceleration has to be achieved. However this must not increase the drag of the projectile to such an extent that the radius of action of the projectile, which has no drive after the launching, is adversely affected. In order to permit a sophisticated steering law, the steering means have to include an inertial reference. Only a small volume is available for the steering means. The high speed of the projectile in the supersonic range results in heating of the projectile.

In accordance with the invention, the object stated hereinbelow is achieved by the combination of the following features:

(a) An optical seeker comprises a gyro with a gyro rotor supported, in operation, by compressed air supplied to a gap between a rotor surface and a bearing surface surrounding said rotor surface.

(b) An imaging optical system comprising a Cassegrain system, and a detector are provided on said air supported gyro, said imaging optical system being arranged to focus target radiation on said detector and to scan a field of view with a gyrating scanning motion.

(c) The projectile, at its front tip, is closed by an optically transparent, planar window.

(d) The optically transparent window carries a central spike.

(e) The projectile is provided with tail stabilizing fins and wings in its mid-portion, said wings being controlled by signals from said detector and said gyro through signal processing means and servomotor means.

(f) The projectile is shaped to be driven aerodynamically to make a continuous roll movement.

Most of the measures recited above are known per se: Gyros mounted in air bearings are known. Seekers having a Cassegrain system are known. It is well-known to cause rotation of an image by means of a wedge and thereby, in combination with an additional gyrating scanning motion, to achieve a rosette scanning. Spikes are well-known with high speed projectiles. Also both tail stabilizing fins and steering by wings in the middle portion of the projectile or missile are known in projectiles or missiles. And it is known to impart a roll movement to a projectile.

However by the combination of measures recited above the problem is solved to provide a steering of a cannon launched projectile in the end phase of its trajectory under the unfavorable conditions explained above. The measures recited cooperate to solve this problem.

The seeker is a gyro, whereby an inertial reference for the steering is available. As the projectile is subjected to extremely high accelerations during the launching, the gyro is mounted on an air bearing. Any other type of bearing would be destroyed by the high accelerations. It has been found, however, that a gyro mounted on an air bearing endures these accelerations and will then be operative. A gyro mounted on an air bearing, however, permits only small squint angles. Therefore the projectile has to be aligned with the target quite accurately. The transverse accelerations occurring during the pursuit of the target must not be achieved by means of an angle of attack of the projectile, as with a number of other missiles. Such an angle of attack could result in the seeker losing the target because of the limited squint angle. Therefore the projectile is steered by means of wings located in the middle portion of the projectile. Such steering means consist of pairs of coupled wings arranged in cross configuration in the region of the center of gravity of the projectile. The wings are arranged to be deflected by the steering signals through servomotors. It has been found that with this type of steering the transverse accelerations required to steer the projectile onto the target can be achieved without the seeker losing the target, even though the squint angle of the seeker is limited by the gyro mounted on an air bearing.

The steering by wings in the mid-portion of the projectile also permits a spike to be used. As compared to conventional seeker domes, the spike causes considerable reduction of the drag. This is quite essential with the high speeds of the projectile and, indeed, makes it possible to provide such a projectile with a seeker. A condition for the use of a spike is, however, that the projectile, during its steering phase, flies without noticeable angle of attack. Otherwise the spike would have an adverse aerodynamic effect. This performance is, however, achieved by the steering through centrally arranged wings, which are provided anyhow because of the limited squint angle of the seeker.

A spike offers the advantage that the pressure head temperature at the window of the seeker is lowered, because the spike changes the straight compression impact with high conversion of kinetic energy to heat to an oblique impact. This results in lower thermoshock load on the window material. In addition, the lower temperature at the window is favorable for detectors which respond to infrared radiation, and thus improves the detection range of the system.

The use of a spike necessitates, however, the use of an imaging optical system which is not disturbed by the spike. Such an imaging optical system is a Cassegrain system. With appropriate dimensioning of the geometry of the spike and of the imaging optical system to take care of the limited squint angle of the seeker, radiation losses by shadow formation can be substantially avoided. A Cassegrain systen, in addition, has a rather high stability against accelerations.

Another question is, how the field of view is to be scanned. Complex scanning mechanisms cannot be used because of the high accelerations. Therefore the fact is utilized that projectiles exhibit a roll movement, if they are not stabilzed in roll by particular control means. According to the invention this is used for the scanning of the field of view. The imaging optical system mounted on the gyro carries out a comparatively quick scanning motion. Preferably this is achieved by exciting the airsupported gyro to controlled nutating motions. A second, slower scanning motion is obtained from the roll movement of the projectile. To this end, a wedge is provides as an optical window instead of the conventional dome, this wedge being limited by two planar surfaces. This quasi-planar window carries the spike. Thereby improved imaging characteristics and a rotating motion relative to the detector are achieved. This rotating motion together with the gyrating motion of the imaging optical system are combined to provide a rosette scanning.

Modifications of the invention are claimed in the dependent claims.

BRIEF DESCRIPTION OF THE DRAWINGS

An embodiment of the invention will be described hereinbelow with reference to the accompanying drawings.

PREFERRED EMBODIMENT OF THE INVENTION

Figure 1:
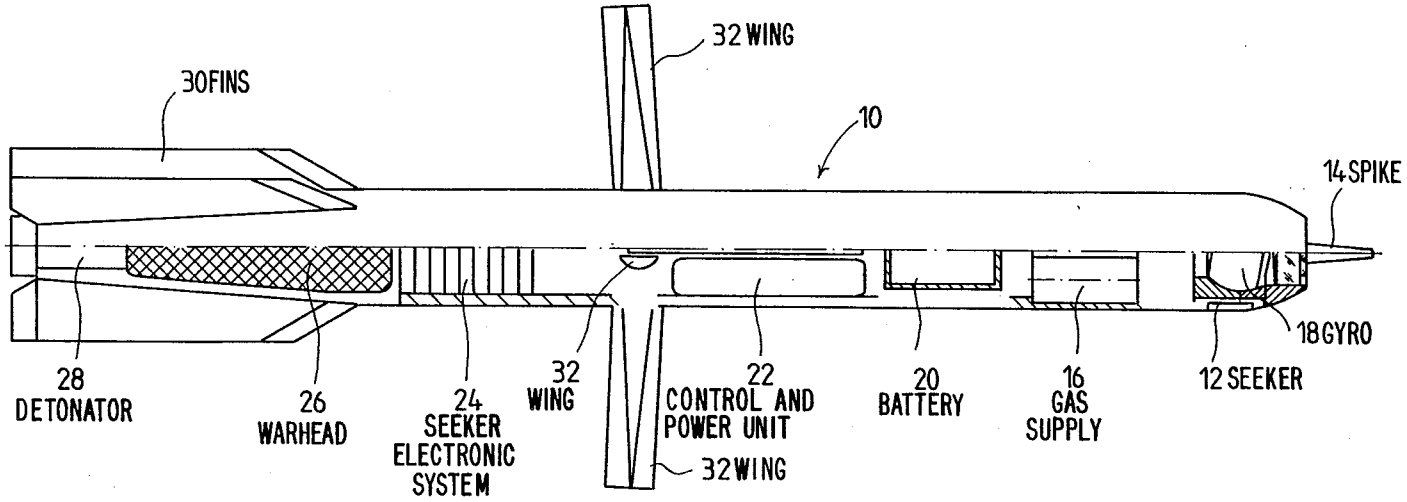
FIG. 1 is a side elevation, partly in section, of a projectile with steering means for steering the projectile onto the target during the final phase of its trajectory.

The projectile 10 has a seeker 12 at its tip. The seeker 12 carries a spike 14. A gas supply 16 for an air bearing supporting a gyro 8 is arranged behind the seeker 12. The gyro 18 represents an essential element of the seeker 12. A battery 20 for the power supply is located behind the gas supply. Adjacent to the battery 20 is a unit 22, which contains a control surface actuator system and the power electronic system associated therewith. Behind unit 22, the seeker electronic system 24 is located. A warhead 26 and a detonator 28 are arranged in the tail portion of the projectile. The battery 20 provides the power for the seeker 12, the power electronic system and the control surface actuator system, as well as the seeker electronic system 24. Fins 30 on the tail portion provide tail stabilization. Control surfaces or wings 32 in crossed wing configuration are provided in the region of unit 22 of the control surface actuator system. These control surfaces or wings provide steering by centrally located wings. The control sufaces or wings are retracted during launching and are unfolded during the steering phase. As the control surfaces or wings are located near the center of gravity of the projectile 10, they are able to exert transverse forces for steering purposes without a noticeable angle of attack occurring. During the steering phase, the control surfaces or wings 32 are actuated by the control surface acutator system in unit 22. This system is controlled by the seeker electronic system 24 through the power electronic system. The seeker electronic system receives and processes signals from the seeker 12.

Figure 2:
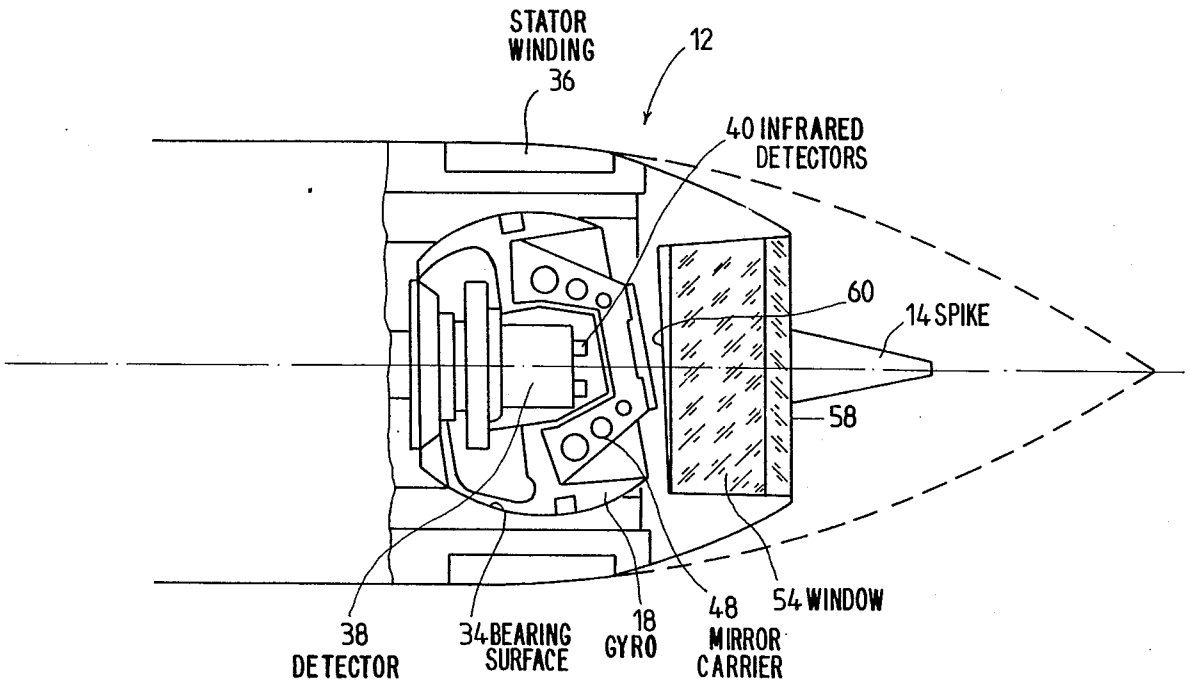
FIG. 2 is a longitudinal sectional view of the seeker.

The seeker 12 is illustrated in FIG. 2 at an enlarged scale. The gyro 18 of the seeker 12 is mounted in a spherical bearing surface 34 on pressurized gas. Mounting of rotors on pressurized gas is a well-known technique and, therefore, is not described here in detail. The gyro rotor may be mounted on an air bearing similar to that described in US-A-4,339,097. A pressurized gas flow is directed into the bearing surface, whereby the gyro 18 with its spherical outer surface is kept floating on a layer of air. The gyro is driven electrically by means of a stator winding 36 or pneumatically. The gyro 18 rotates about a projectile—fixed detector column 38. Infrared sensitive detectors 40 are arranged on the detector column. The detector column contains a cooling device, by means of which the detectors 40 are cooled. Such cooling device may, for example be of the type described in US-A-2,990,699 or GB-A-2,199,399.

Figure 3:
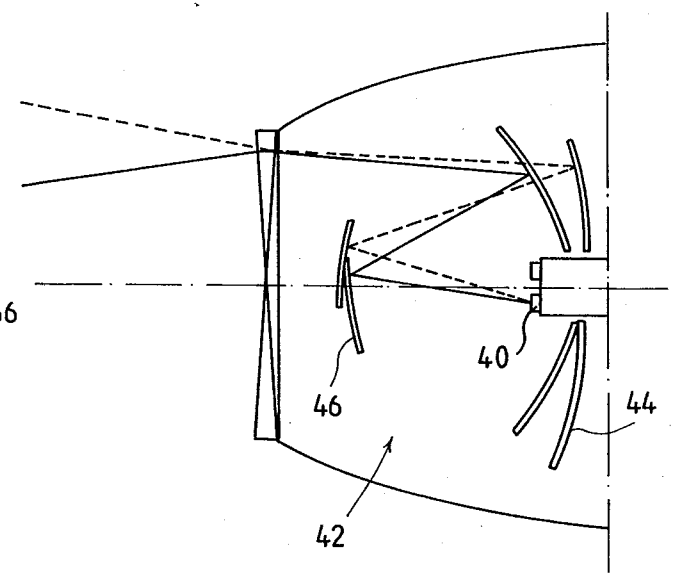
FIG. 3 illustrates schematically the motion of the seeker for the scanning of the field of view.

As can be seen best from the schematic FIG. 3, the gyro carries an imaging optical system 42 in the form of a Cassegrain system comprising an annular concave mirror 44 as primary mirror and a mirror 46 as secondary mirror arranged at a distance in front of the concave primary mirror. The optical path of the imaging optical system runs, as illustrated in FIG. 3, from the object, which virtually is at infinity, via the annular concave mirror 44 and mirror 46 to the detector 40. The mirror 46 is mounted on the gyro 18 through a rugged mirror carrier 48.

As can be seen from FIG. 3, the imaging optical system 42 makes a gyrating scanning motion. This is achieved by exciting the gyro 18 to carrying out a controlled nutating motion.

The seeker 12 is closed by a planar window 54. The window consists of infrared-transparent material. The window 54 is wedge-shaped and is limited by planar surfaces 58 and 60.

Figure 4:
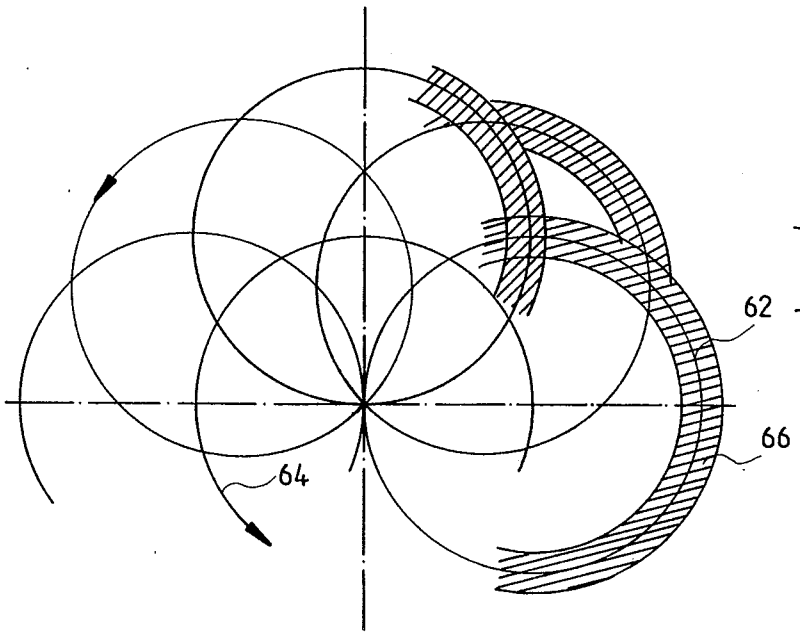
FIG. 4 illustrates the rosette scanning of the field of view obtained by the combination of the scanning motion of the seeker and the roll movement of the projectile.

The control surfaces 32 are provided with a twist, such that the projectile carries out a continuous roll movement. As can be seen from FIG. 3, the optical path of the imaging optical system 42 is deflected thereby and thus the point of the scanned field of view, which is detected by the detector, is changed. When the projectile carried out its roll movement without the scanning motion of the imaging optical system 42, an annular area of the field of view extending around the projectile axis would be scanned. This relatively slow scanning motion caused by the roll movement of the projectile is, however, superimposed to the quick scanning motion of the imaging optical system. A rosette scanning results, as indicated in FIG. 4. Due to the nutating motion of the gyro 18 and the relatively quick scanning motion of the imaging optical system 42 caused thereby, the individual "leaves" 62 of the rosette are passed through. The roll movement of the projectile 10 because of the wedge rotating therewith causes a superimposed slower rotation along the scanning circle 64. By providing a plurality of detectors 40, an annular strip 66 is scanned with each leaf of the rosette, thus with each nutation revolution of the gyro 18, as illustrated in FIG. 4.

The window 54 carries the spike 14. Thereby the drag of the projectile 10 is reduced. The air flow is partly deflected away from the window 54, whereby heating up is reduced.

We claim:

1. A projectile with steering means for steering the projectile onto a target during the end phase of its trajectory, characterized by the combination of the following features:

(a) An optical seeker (12) comprises a gyro (18) with a gyro rotor supported, in operation, by compressed air supplied to a gap between a rotor surface and a bearing surface surrounding said rotor surface;

(b) An imaging optical system (42) comprising a Cassegrain system, and a detector (40) are provided on said air supported gyro, said imaging optical system being arranged to focus target radiation on said detector (40) and to scan a field of view with a first gyrating scanning motion;

(c) The projectile (10), at its front tip, is closed by an optically transparent, planar window (54);

(d) The optically transparent window (54) carries a central spike (14);

(e) The projectile is provided with tail stabilizing fins (30) and wings (32) in its mid-portion, said wings (32) being controlled by signals from said detector (40) and said gyro (18) through signal processing means (24) and servomotor means (22); and, (f) The projectile (10) is shaped to be driven aerodynamically to make a continuous roll movement and, thereby, to provide a second gyrating scanning motion of said seeker (12).

2. A projectile as claimed in claim 1, wherein said gyro (18) is energized to make a controlled nutating movement for providing said first gyrating scanning motion.

3. A projectile as claimed in claim 1, wherein said optical window (54) is wedge-shaped and wherein the roll movement of the projectile and the wedge-shaped window cooperate to provide said second gyrating scanning motion.

4. A projectile as claimed in claim 1, wherein said detector is an infrared detector and said window (54) is transparent for infrared radiation.

5. A projectile as claimed in claim 4, wherein cooling means are provided to cool said detector (40).

6. A projectile as claimed in claim 1, wherein said detector comprises a plurality of detector elements, whereby an annular strip (66) of the field of view is scanned during each revolution of said gyrating scanning motion.

* * * * *